United States Patent [19]

Haig

[11] 4,372,994

[45] Feb. 8, 1983

[54] SYNTHETIC PLASTICS COATING

[76] Inventor: Frederic D. Haig, 64 Trennerry Crescent, Abbortsford, Victoria, Australia

[21] Appl. No.: 228,477

[22] Filed: Jan. 26, 1981

[30] Foreign Application Priority Data

Jan. 24, 1980 [AU] Australia ..... PE2136

[51] Int. Cl.[3] ..... B05D 1/24; B05D 1/42

[52] U.S. Cl. ..... 427/195; 427/243; 427/345; 427/434.5; 118/312; 118/419

[58] Field of Search ..... 427/185, 195, 243, 434.5, 427/345; 118/312, 419

[56] References Cited

U.S. PATENT DOCUMENTS

| | | | |
|---|---|---|---|
| 3,389,010 | 6/1968 | Burch | 427/185 X |
| 3,650,798 | 3/1972 | Case et al. | 427/195 |
| 3,922,384 | 11/1975 | Tadewald | 427/185 X |
| 3,962,990 | 6/1976 | Phipps et al. | 427/195 X |
| 4,070,503 | 1/1978 | Robert | 427/195 X |
| 4,238,522 | 12/1980 | Potts | 427/195 X |

*Primary Examiner*—Shrive P. Beck

*Attorney, Agent, or Firm*—Andrus, Sceales, Starke & Sawall

[57] ABSTRACT

A technique for coating a longitudinally extending member feeds particulate plastics coating material onto a horizontal support to form a mound. The mound is pendulously swung back and forth along a path of movement of the member. The member is heated and passed through the pendulously swinging mound of plastics material to coat the member with the material.

12 Claims, 5 Drawing Figures

SYNTHETIC PLASTICS COATING

This invention relates to synthetic plastics coating.

In a particular aspect, this invention relates to coating longitudinally extending members such as wire, rod, tube, strand, strip, plate and mesh; preferably wire meshes.

The present invention provides a method of coating a longitudinally extending member with synthetic plastics material comprising feeding a synthetic plastics material in particulate form on to a support to form a mound of said material thereon, and passing a heated longitudinally extending member through said mound thereby to coat said member with said material.

The present invention also provides apparatus for coating a longitudinally extending member with synthetic plastics material comprising a support for a mound of synthetic plastics material, and means for passing a heated longitudinally extending member through said mound thereby to coat said member with said material.

The synthetic plastics material may be theremosetting but is preferably thermoplastic.

Preferably the support is moved to maintain at least part of the mound in motion. In this last respect, the support may be reciprocated up and down but preferably it is reciprocated or oscillated in a generally horizontal plane. In a preferred instance the support is arcuately reciprocated. It is not believed that the radius of arc is critical.

A means for feeding powder preferably acts to maintain the mound. In this last respect, some change in the size of the mound with time may occur and to some extent will be acceptable. In general, the mound should be maintained at at least a predetermined size for such time as the mesh is passing therethrough.

The means for feeding powder may or may not include a hopper above said support. If a hopper is used its height above the support does not appear itself to be critical but the hopper should be dimensioned or so feed as to maintain the size of the mound as is desired. However, preliminary observations indicate that the height of the mound, and hence the pressure generated by said material, may be significant in that some pressure may be desired but too much can be difficult to control. At present Applicant prefers that the mound should have a height of 2 inches but this may vary from material to material.

The support should be open in the direction in which said member is passed but may have upstanding walls parallel to that direction to help to contain the mound.

The synthetic plastics material is likely to fall off the support particularly if the support is reciprocated or oscillated and said member will tend to draw material off said support and hence it is preferred that there is a means to collect said material which falls off the support.

The means for feeding said material may include means for recycling said material from said means to collect to the support. Said means for recycling may include a conveyor adapted to convey said material from said means to collect to the support.

Said means to collect preferably includes means for forming a fluidized bed of said material collected thereby.

A specific construction of apparatus in accordance with this invention and its method of use will now be described with the aid of the accompanying drawings in which.

Figure 1:
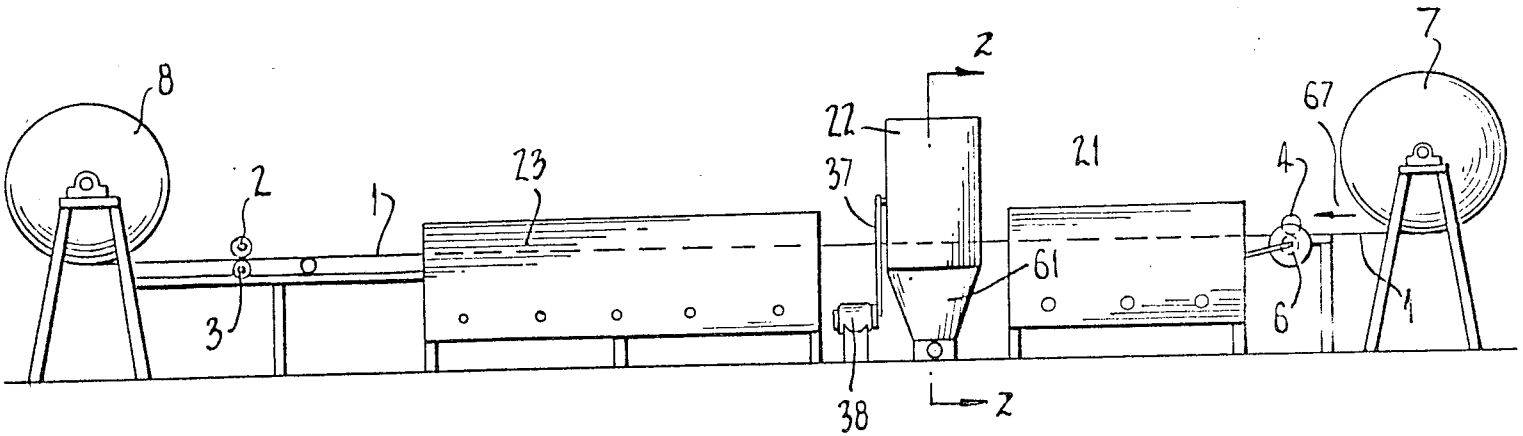
FIG. 1 is a side elevation of the apparatus.
Figure 5:
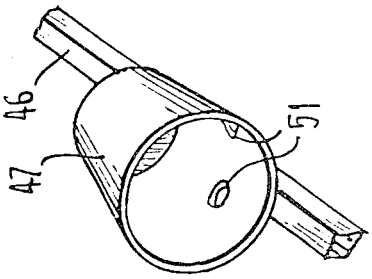
FIG. 5 is a perspective view of part of the apparatus.
Figure 2:
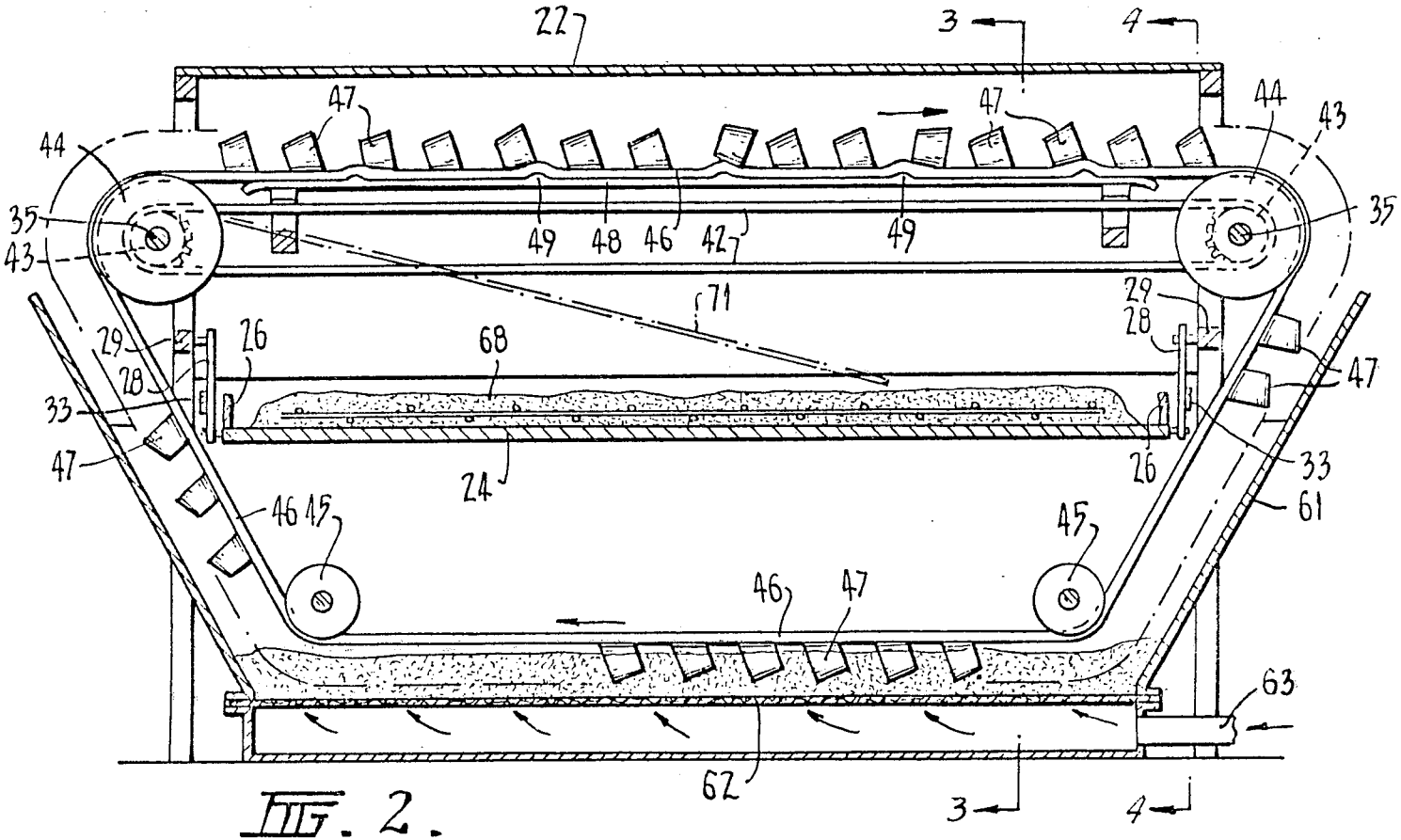
FIG. 2 is a cross-section on line 2—2 in FIG. 1.
Figure 4:
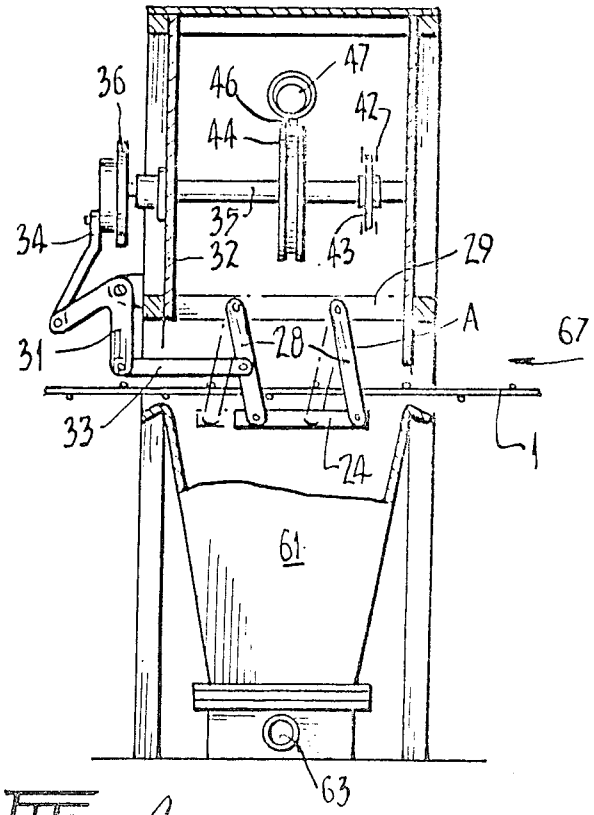
FIG. 4 is a cross-section on line 4—4 in FIG. 2.
Figure 3:
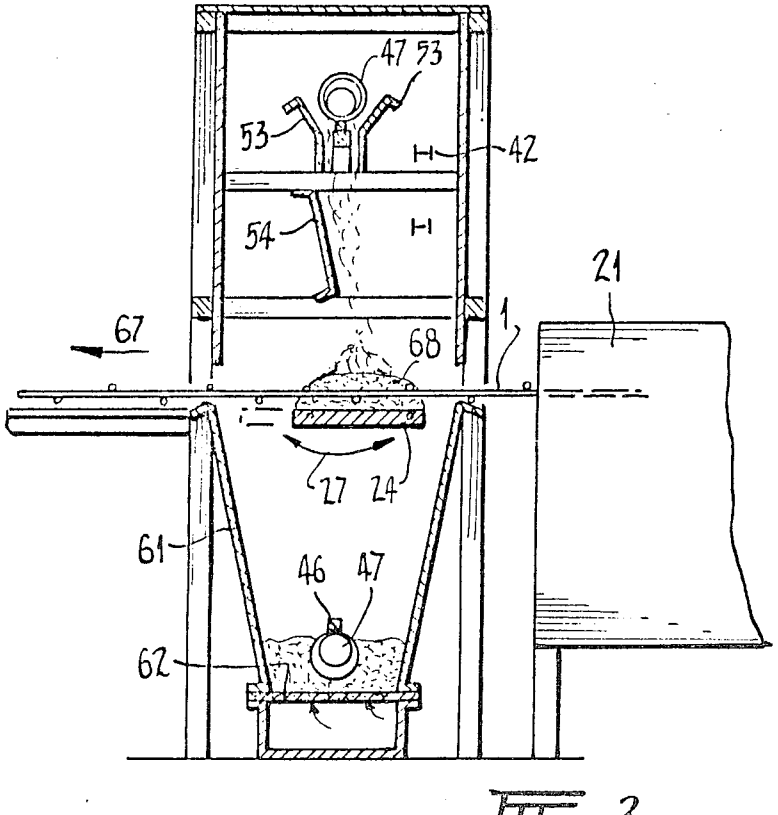
FIG. 3 is a cross-section on line 3—3 in FIG. 2.

The apparatus shown in the drawings includes a conveyor means for conveying a length or a continuous length of a longitudinally extending member such as a wire mesh 1. The conveyor means includes driven rollers 2 and 3 and braked rollers 4 and 6. A supply roll 7 of the mesh 1 is provided and a take-up roll 8 for the mesh 1 is also provided.

Intermediate the rollers 2 and 3 and 4 and 6 is a pre-heating oven 21, an applicator 22 and a post-heating oven 23.

The pre-heating oven 21 serves to heat the mesh 1 before the mesh 1 passes to the applicator 22.

The applicator 22 includes a table 24, side walls 26 on the table, means for arcuately reciprocating the table in the directions indicated by arrows 27 including parallel arms 28 at each end of the table 24, a bar 29 to which the arms 28 are mounted, a crank 31 mounted to a casing 32 and which is connected to one of the arms 28 via a push rod 33, a crank 34 which is connected to the crank 31 and eccentrically to a shaft 35 which carries a pulley 36, a chain drive 37 and a drive motor 38. Excepting for pulley 36, chain drive 37 and motor 38, an identical means for arcuately reciprocating the table is provided at the other end of the table 24.

The applicator further includes a powder conveyor which itself includes the shafts 35 to one of which the pulley 36 is connected to drive, a chain drive 42 passing between sprockets 43 on the shafts 35, pulleys 44 and 45 over which a belt 46 runs, conveyor buckets 47 fixed to the belt 46 and a surface 48 having bumps 49 thereon. The buckets 47 are provided with holes 51.

Beside the upper strand 52 of the powder conveyor are guides 53 which guide falling powder and beneath the upper strand 52 is a deflector plate 54 which guides falling powder to that side of the table 24 which is upstream with respect to the direction of movement of the mesh 1.

Beneath the table 24 is a fluidized bed container 61 which includes a porous base 62 and a gas duct 63 for the passage of gas to fluidized powder in the container 61.

In use, the mesh 1 is passed in the direction of arrow 67 from the supply roll 7 under the control of the rollers 2, 3, 4 and 6. The mesh 1 passes through the pre-heat oven 21 where it is heated and then passes to the applicator 22.

At the applicator thermoplastic powder 70 in the container 61 is fluidized by gas through the duct 63 and porous base 62, the powder conveyor is operated to cause the buckets 47 to move through the fluidized bed of powder in the container 61 and collect the powder. The buckets 47 are lifted above the surface 48 and commence to trickle powder from the holes 51 with the bumps 49 serving to ensure that the powder is caused to move.

Falling powder will be deflected by the deflector plate 54 on to the table 24 to form a mound 68 of powder thereon.

The means for arcuately reciprocating the table 24 will cause the mound 68 to arcuately reciprocate and make good contact with the mesh 1 particularly in regions where strands of the mesh 1 intersect one another. Thus, the hot mesh 1 will become coated with powder which should fuse to it and the outer regions of the powder coating will be fused by the post-heating oven 23 to form a plastic coated wire mesh which is wound up on the take-up roll 8.

It is to be noted that the powder will to some extent be retained by the side walls 26 but some will fall, or be pulled off by the mesh 1 and fall, to the container 61. However, the mound is continuously replenished.

By the use of the above apparatus Applicant has produced good quality coatings on wire mesh.

The present invention may be applied to coating only part of the width of a longitudinally extending member; to accomplish this a deflector plate 71 may be used to ensure that powder is deposited only at one end of the table 24. Alternatively, the powder conveyor may be otherwise arranged to supply powder to one defined region of the table 24 or the table 24 might be appropriately dimensioned and located for partial coating.

In the event that the apparatus is used for coating plate or strip having a width transverse to the direction of travel greater than the mound 68 depth it may be desirable that the table 24 be given a component of motion transverse to the direction of travel so as to provide powder beneath that strip or plate.

The claims form part of the disclosure of this specification.

Modifications and adaptations may be made to the above described without departing from the spirit and scope of this invention which includes every novel feature and combination of features disclosed herein.

I claim:

1. A method for coating a longitudinally extending member moving along a path with thermally responsive, synthetic plastics material comprising the steps of:

feeding the plastics material in particulate form onto a horizontal support to form a mound of material thereon;

pendulously swinging the support and mound formed thereon back and forth along the path of the member so that said support and mound have horizontal and vertical components of motion;

heating the longitudinally extending member; and passing the longitudinally extending member through the pendulously swinging mound of plastics material to coat the member with the material.

2. A method as claimed in claim 1 wherein the initial step is further defined as feeding a thermoplastic material in particulate form onto a horizontal support.

3. A method as claimed in claim 1 wherein the initial step is further defined as continuously feeding the material onto a horizontal support.

4. A method as claimed in claim 1 wherein the passage of the member through the mound displaces particles of material from the mound and wherein the method further includes the step of recovering the displaced particles and returning same to the mound.

5. A method as claimed in claim 1 further including the step of heating the longitudinally extending member after passing it through the mound.

6. A method as claimed in claim 1 further defined as coating a wire mesh with plastics material.

7. Apparatus for coating a longitudinally extending member with thermally responsive, synthetic plastics material comprising:

means for passing the longitudinally extending member along a horizontal path;

means positioned along said horizontal path for heating the member;

horizontal support means downstream of said heating means along said path;

means for pendulously swinging said support means back and forth along the path of the member so that said support means has horizontal and vertical components of motion; and means for feeding the plastics material in particulate form onto the support means to form a mound of material thereon through which the member passes to be coated with the material.

8. An apparatus as claimed in claim 7 wherein said feeding means is further defined as continuously feeding means for the plastics material.

9. An apparatus as claimed in claim 7 further including means for recovering particles of material displaced from the mound of material and returning same to said feeding means.

10. An apparatus as claimed in claim 9 wherein said recovery and returning means comprises a container located beneath said support means for receiving particles of material displaced from the mound and conveyor means for conveying the displaced particles of material to said feed means.

11. An apparatus as claimed in claim 7 including heating means located downstream of said support means along said horizontal path.

12. An apparatus as claimed in claim 7 further defined as coating a longitudinally extending member comprising a wire mesh.

* * * * *